United States Patent [19]

Cech

[11] 4,100,693

[45] Jul. 18, 1978

[54] STRIKER CARTRIDGE

[76] Inventor: Theo Cech, Dobersbergerstr. 6, Karlstein, Thaya, Austria, 3822

[21] Appl. No.: 764,634

[22] Filed: Feb. 1, 1977

[30] Foreign Application Priority Data

Feb. 3, 1976 [AT] Austria ..... 736/76

[51] Int. Cl.[2] ..... F41C 27/08
[52] U.S. Cl. ..... 42/1 N
[58] Field of Search ..... 42/1 N, 1 LP

[56] References Cited

U.S. PATENT DOCUMENTS

| | | | |
|---|---|---|---|
| 1,229,991 | 6/1917 | McGavisk | 42/1 N |
| 2,405,308 | 8/1946 | Jack | 42/1 N |
| 2,594,778 | 4/1952 | Hoard | 42/1 N |
| 2,985,979 | 5/1961 | Doyle et al. | 42/1 N |
| 3,564,746 | 2/1971 | McConnell | 42/1 N |

FOREIGN PATENT DOCUMENTS

| | | | |
|---|---|---|---|
| 596,261 | 12/1947 | United Kingdom | 42/1 N |

OTHER PUBLICATIONS

*Shooter's Bible,* 1963 Edition, p. 112, "Snap Caps".

*Primary Examiner*—Charles T. Jordan
*Attorney, Agent, or Firm*—John J. Dennemeyer

[57] ABSTRACT

A striker cartridge for weapons using central firing cartridges especially for shotguns has a jacket in whose bottom a circular opening is provided in the impact area of the firing pin. An impact element is inserted into this opening from the inside of the jacket and is biased by a resilient spring oppositely to the impact direction of the firing pin. The opening for receiving the impact element is arranged excentrically to the jacket axis and the impact element is rotatably mounted in this opening so that after repeated striking of the firing pin against the impact element it is rotated to expose a new intact area to the firing pin.

12 Claims, 4 Drawing Figures

STRIKER CARTRIDGE

Figure 1:
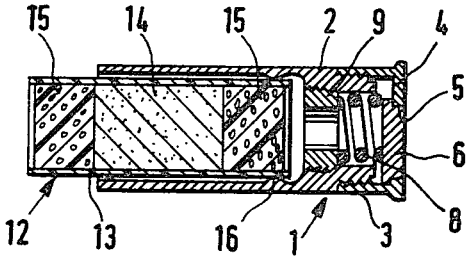

The invention relates to a striker cartridge for weapons using central firing cartridges, especially shotguns, and comprising a jacket similar to a regular cartridge jacket with a circular opening in its bottom in the striking area of the firing pin, and an impact element is inserted through the inside of the jacket and is biased oppositely to the impact direction of the firing pin by a spring member.

In the conventional striker cartridges of this type a circular opening for receiving the impact element is arranged centrally in the jacket bottom. A disadvantage of such a striker cartridge is the fact that after having been used a few times a depression has formed in the surface of the impact element by the repeated striking of the firing pin and accordingly the full effect of the striker cartridge is no longer assured so that it must be replaced by a new cartridge or at least requires a changing of the impact element.

This disadvantage is eliminated according to the invention in a striker cartridge of the above mentioned conventional type in that the opening which receives the impact element is arranged excentrically to the jacket axis and the impact element is arranged rotatably in the opening. In this manner it is possible to rotate the impact element to a small degree in the opening of the jacket bottom as soon as a depression has been formed in the impact element due to a repeated firing of the weapon, and this rotation will move an intact area of the impact element into the center of the jacket bottom, i.e. into the striking range of the firing pin, and the striker cartridge possesses again its full effect. This procedure can be repeated until the circle of depressions created in the surface of the impact element has closed.

In order to make the diameter and thus the circumference of this circle as large as possible one can provide according to a preferred embodiment of the invention an arrangement which is such that the diameter of the opening corresponds to approximately half the diameter of the jacket bottom.

According to an additional feature of the present invention the impact element can have the shape of a disk having a stepped form wherein the disk having the smaller diameter has a thickness which corresponds to the wall thickness of the jacket bottom and a diameter which corresponds approximately to the diameter of the opening of the jacket bottom. Such a design has the advantage that the impact element is supported at its area of larger diameter directly on the inner side of the jacket bottom.

The impact element can also be designed so that it has the shape of a disk with a central portion of larger diameter and a top and bottom portion of smaller diameter wherein the portions of smaller diameter each have a thickness which corresponds to the wall thickness of the jacket bottom and a diameter which corresponds to the diameter of the opening in the jacket bottom. This arrangement has the advantage of providing a direct support of the impact element by the jacket bottom and in addition the advantage that both sides of the impact element can be used.

According to an additional feature of the invention the outside of the impact element can be provided with one or more slots so that a tool or other means can be inserted therein in order to turn in a simple manner the impact element in the opening of the jacket bottom. The invention includes also a stiker cartridge for guns using small shot cartridges, commonly called shotguns, which is characterized in that the jacket bottom has additionally one or more openings and a corrosion resistant insert element may be slid into the jacket.

Such corrosion resistant cartridges for hunting guns are already known and one type is sold under the trademark "STOR-SAFE", this type of cartridge being inserted in the gun instead of a real cartridge before the gun is stored away. Such cartridges consist of a cartridge jacket provided with an insert element containing a chemical substance which diffuses corrosion resistant chemical gases that penetrate forwards into the gun barrel and rearwards through openings in the jacket bottom also into the breech parts of the gun.

The combination of such a known corrosion resistant cartridge with a striker cartridge according to the invention is not known so far. This combination has the important advantage that the corrosion resistant insert element needs to be exchanged only from time to time while the cartridge jacket itself can be used practically indefinitely.

With the known corrosion resistant cartridges the uncocking of a gun could not be made without danger of damaging the firing mechanism.

Figure 2:
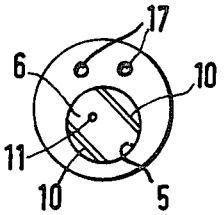
Figure 3:
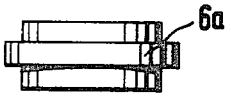
Figure 4:
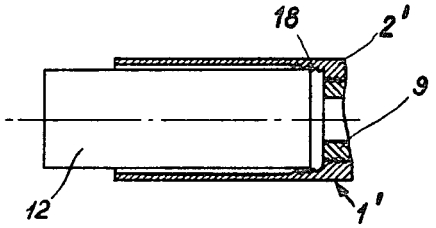

The objects and advantages of the invention will appear more clearly from the following description of an embodiment according to the invention described in detail with reference to the accompanying drawing in which:

FIG. 1 shows a longitudinal section through a striker cartridge according to the invention, FIG. 2 is a plan view of the jacket bottom of the striker cartridge according to FIG. 1, FIG. 3 shows on an enlarged scale a side view of an impact element whose two sides can be used according to the invention, and FIG. 4 is a partial longitudinal section through a modified cartridge, wherein the tubular part is provided with an internal, conical thread for securing the insert.

The striker cartridge illustrated in FIGS. 1 and 2 consists of a jacket 1 having the form of a regular cartridge jacket which consists of a tubular part 2 and a cap 3 which is threaded onto part 2. The end of this tubular part adjacent the cap is provided with a screw thread and reduced in diameter in such a way that the outside surfaces of the two parts 2 and 3 when threaded together provide an even surface of the two parts merging together. In the bottom 4 of the jacket thus constituted a circular opening 5 is disposed excentrically to the jacket axis and an impact element 6 having the shape of a stepped diameter disk whose area of smaller diameter is fitted into the opening 5 by inserting it from the inside of the jacket. The thickness of the area of smaller diameter on the impact disk 6 corresponds to the wall thickness of the jacket bottom so that the outer surface of the impact disk and the outer surface of the jacket bottom lie in the same plane. The impact disk 6 which may be produced from a synthetic material or of a soft metal, e.g. soft aluminum, is resiliently biased oppositely to the impact direction of the firing pin (not shown) by a spiral spring 8, and the spring itself is resting against a ring shaped abutment 9 provided on the inside of the tubular part 2 in the region of its end adjacent the cap 3. This ring shaped abutment 9 is formed in the embodiment illustrated in the drawing in a simple manner by a ring which is threaded into the tubular part 2. Such a ring also makes it easy to adjust the force of the spring 8 to the striking force of the particular weapon. At its outside the impact disk presents one or more slots 10 for engaging a tool or the like for rotating the impact disk.

As indicated above the impact disk arranged excentrically to the jacket axis provides in comparison with impact elements arranged centrally as known from the prior art arrangements the advantage that as soon as a depression is formed in the impact disk after repeated use of the striker cartridge and which could reduce the full effect of the striker cartridge during further use a still intact area of the disk can be moved into the striking range of the firing pin by a slight rotation of the impact disk in the opening 5, and thus the full effect of the striker cartridge can be restored. This procedure can be carried out in a simple manner by slightly loosening the threaded connection between the tubular part 2 and the cap 3 in order to reduce the spring force acting on the impact disk or even to completely cancel it and thereafter inserting a tool or other suitable means into a slot 10 in the impact disk and by making an appropriate rotation of the impact disk. A suitable tool will be for example a screw driver, a knife blade or even the finger nail.

A maximum circumference of the circle formed on the impact disk by the impact points made by the firing pin and consequently a longer utilization of the impact disk is obtained when the diameter of the opening 5 corresponds to approximately half the diameter of the jacket bottom 4 and the center of the impact disk is removed as far as possible from the jacket axis.

A bilateral utilization of the impact disk can be obtained by using an embodiment of the impact disk such as illustrated in FIG. 3 in which the impact disk *6a* has two outer regions with a diameter corresponding to the diameter of the opening 5, so that after complete utilization of one side the disk is reversed and its use continued with the other still intact side of the disk located on the outside in the jacket bottom.

In the embodiment illustrated in the drawing a corrosion resistant insert member 12 is slipped into the jacket 1 of the striker cartridge. This type of corrosion preventing cartridge is already known and sold under the tradename STOR-SAFE. Such an insert consists of a tubular sleeve 13 of synthetic material and contains in its central portion a material 14 which diffuses a corrosion preventing chemical gas, and the sleeve is closed in its end portions by means of a gas impervious material 15. In order to retain the insert 12 in the jacket 1 of the striker cartridge a peripheral nose 16 is provided on the inside of the jacket and its open width corresponds to the diameter of the insert. The tubular part 2 could also be provided with a preferably conical inner screw thread so that the insert could be threaded in. A modification with this arrangement is shown in FIG. 4, wherein the tubular part 2' of the jacket 1' contains a conical or tapered screw thread 18, into which the forward end of the insert 12 is threaded. In order to make is possible for the corrosion preventing gases to reach rearwardly to the breech parts of the gun when the striker cartridge is inserted in a gun to be stored gas passages 17 may be provided in the bottom 4 of the jacket as can be seen in FIG. 2 of the drawing.

In comparison with the known corrosion preventing cartridges the combination of the invention with a striker cartridge presents the advantage that depending on the need merely the insert 12 has to be renewed while the jacket 1 of the corrosion preventing cartridge or striker cartridge can be used for a practically unlimited period.

What is claimed is:

1. A striker cartridge for weapons with central firing cartridges, especially for shotguns, consisting of a jacket similar to a regular cartridge jacket and including a generally tubular side wall and a bottom wall, in whose bottom wall a circular opening is provided in the impact area of the weapon's firing pin and into which opening an impact element is inserted from the inside of the jacket and biased by a resilient spring oppositely to the impact direction of the firing pin, the improvement consisting in that the opening (5) for receiving the impact element (6) is arranged eccentrically to the jacket's longitudinal axis, and the impact element is rotatably mounted in this opening.

2. A striker cartridge according to claim 1, wherein the diameter of the opening (5) corresponds to approximately half the diameter of the jacket bottom wall, and the center of the impact element (6) is as remote as possible from the jacket's longitudinal axis.

3. A striker cartridge according to claim 2, wherein the impact element (6) has the form of a stepped disk with different diameters, the disk areas of smaller diameter having a thickness which corresponds to the wall thickness of the jacket bottom wall, (4), and a diameter which corresponds approximately to the opening (5) in the jacket bottom wall.

4. A striker cartridge according to claim 2, wherein the impact element *(6a)* has the form of a stepped disk comprising a central area of larger diameter and two adjacent outer areas of a smaller diameter, each area of smaller diameter having a thickness which corresponds to the wall thickness of the jacket bottom wall (4), and a diameter which corresponds approximately to the diameter of the opening (5) in the jacket bottom wall, said outer areas being on opposite sides of said larger diameter central area.

5. A striker cartridge according to claim 1, wherein the outer face of the impact element (6) has one or more slots (11) for rotating said element.

6. A striker cartridge according to claim 1, in which the generally tubular side wall of said jacket (1) consists of a tubular part (2) and of a cap (3) including a tubular portion that is threaded on said tubular part, said cap carrying said bottom wall of said jacket, and said tubular part carrying on its inside a ring shaped abutment (9) in the area of its end facing the bottom wall of said jacket, said resilient spring (8) resting on said abutment, and extending between said abutment and said impact element.

7. A striker cartridge according to claim 6, wherein the ring shaped abutment (9) consists of a ring member which is threaded into the tubular part (2).

8. A striker cartridge according to claim 6, wherein said ring shaped abutment (9) is threadably mounted within said tubular part, whereby its position can be adjusted to adjust the pressure exerted by said resilient spring.

9. A striker cartridge for shotguns consisting of a jacket similar to a regular cartridge jacket and including a generally tubular side wall and a bottom wall, in whose bottom wall a circular opening is provided in the impact area of the shotgun's firing pin and into which opening an impact element is inserted from the inside of the jacket and biased by a resilient spring oppositely to the impact direction of said firing pin, the improvement consisting in that said jacket bottom wall is provided with at least one additional opening (17), and a sleeve-like insert (12) containing a known chemical substance (14) diffusing a corrosion-preventing gas is replaceably mounted within the generally tubular side wall, said at least one additional opening (17) serving to feed said gas to the breech area of said shotgun.

10. A striker cartridge according to claim 9, wherein a peripheral nose (16) is provided on the inside of the generally tubular side wall of said jacket (1), whose open width corresponds to the diameter of the corrosion preventing insert (12).

11. A striker cartridge according to claim 9, wherein the generally tubular side wall of said jacket (1) has preferably a conical inner screw thread for threading the corrosion preventing insert (12) therein.

12. A striker cartridge according to claim 9, wherein said circular opening (5) is arranged eccentrically to the jacket's longitudinal axis, and the impact element is rotatably mounted in this circular opening, said at least one additional opening (17) being spaced from said circular opening.

* * * * *